US007597841B2

(12) United States Patent
Okazaki et al.

(10) Patent No.: US 7,597,841 B2
(45) Date of Patent: Oct. 6, 2009

(54) WELD METAL EXCELLENT IN TOUGHNESS AND SR CRACKING RESISTANCE

(75) Inventors: Yoshitomi Okazaki, Kobe (JP); Koichi Hosoi, Fujisawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 86 days.

(21) Appl. No.: 11/679,320

(22) Filed: Feb. 27, 2007

(65) Prior Publication Data

US 2007/0253857 A1 Nov. 1, 2007

(30) Foreign Application Priority Data

Apr. 26, 2006 (JP) ..... 2006-122550

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/12*** | (2006.01) |
| ***C22C 38/14*** | (2006.01) |
| ***C22C 38/18*** | (2006.01) |
| ***C22C 38/22*** | (2006.01) |
| ***C22C 38/28*** | (2006.01) |
| ***C22C 38/32*** | (2006.01) |

(52) U.S. Cl. ..... 420/106; 420/83; 420/84; 420/104; 420/105; 420/108; 420/109; 420/110; 420/112; 420/119; 420/121; 420/126; 420/128

(58) Field of Classification Search ..... 420/83, 420/105, 106, 110, 111, 120, 121, 123, 124, 420/126, 127, 128

See application file for complete search history.

(56) References Cited

U.S. PATENT DOCUMENTS 5,407,635 A * 4/1995 Iseda et al. ..... 420/110
6,940,042 B2 9/2005 Hara et al.

FOREIGN PATENT DOCUMENTS

| | | |
|---|---|---|
| JP | 3251424 | 11/2001 |
| JP | 3283763 | 3/2002 |
| JP | 2004-58086 | 2/2004 |
| JP | 2004-91860 | 3/2004 |

OTHER PUBLICATIONS

U.S. Appl. No. 12/024,439, filed Feb. 1, 2008, Okazaki, et al.

* cited by examiner

*Primary Examiner*—Melvin C Mayes
*Assistant Examiner*—Colin W Slifka
(74) *Attorney, Agent, or Firm*—Oblon, Spivak, McClelland, Maier & Neustadt, L.L.P.

(57) ABSTRACT

Provided is a weld metal for Cr—Mo steels which is suppressed in the formation of ferrite bands and therefore has heightened toughness and tensile strength and at the same time, good SR cracking resistance.

The weld metal according to the present invention contains C: 0.02 to 0.06% (mass %, which will equally apply hereinafter), Si: 0.1 to 1.0%, Mn: 0.3 to 1.5%, Cr: 2.0 to 3.25%, Mo: 0.8 to 1.2%, Ti: 0.010 to 0.05%, B: 0.0005% or less (inclusive of 0%), N: 0.002 to 0.0120%, O: 0.03 to 0.07%, and the balance being Fe and inevitable impurities, wherein a ratio of the Ti content [Ti] to the N content [N] satisfies the following range: $2.00<[Ti]/[N]<6.25$.

10 Claims, 3 Drawing Sheets

WELD METAL EXCELLENT IN TOUGHNESS AND SR CRACKING RESISTANCE

BACKGROUND OF THE INVENTION

The present invention relates to a weld metal excellent in toughness and SR cracking resistance. More specifically, the invention pertains to a weld metal for 2.0 to 3.25% Cr-0.8% to 1.2% Me steels (which may hereinafter be called "Cr—Mo steels"). The above-described weld metal is suited for use as a material for welded structures such as power plants or chemical plants.

Ferrite heat-resistant steels such as Cr—Mo steels excellent in high temperature properties have been used popularly as a material for welded structures. Cr—Mo steels often contain alloy elements such as Ti and V for the purpose of improving their strength or the like. Cr—Mo steels and those containing alloy elements will hereinafter be called "Cr—Mo steels" collectively.

Welded structures are usually subjected to heat treatment (Post-Weld heat-treatment, PWHT) after welding in order to remove a stress remaining inside of the weld metal.

When Cr—Mo steels are subjected to PWHT, however, a ferrite structure partially coarsens remarkably and, a strip-like structure (called "ferrite band" and indicated by ● in the drawing) appears at a boundary between beads (each, a weld metal available by a single welding operation (pass)) and causes deterioration in mechanical properties such as toughness and tensile strength. The ferrite band is presumed to occur owing to component segregation during solidification of a weld metal or carbon transfer in the weld metal during PWHT. In addition, as illustrated in FIG. 1B, PWTH causes a problem called intergranular cracking {which is called "reheat cracking" or SR (Stress Relief, stress relief annealing) cracking, but will hereinafter be typified by "SR cracking"}.

Various proposals have been made for preventing such problems.

For example, described in Japanese Patent Laid-Open No. 2004-58086 (which will hereinafter be called "Patent Document 1") or 2004-91860 (which will hereinafter be called "Patent Document 2") is a method of suppressing the formation of a ferrite band by making use of the pinning effect of the precipitate for fixing a grain boundary which will otherwise migrate. Cr—Mo steels containing approximately 1.3% of Cr are main workpiece materials in the latter publication. They are, in a precise sense, different in the amount of Cr from the Cr—Mo steels which are workpiece materials in the present invention.

Patent Document 1 relates to a technology of a flux-cored wire for gas shielded arc welding, in which a titania type flux-cored wire is used in order to generate various precipitates containing Nb, V and Ti both in the grains and grain boundary of the weld metal. Patent Document 2, on the other hand, relates to a technology of a weld metal for heat-resistant low-alloy steel and according to this document, precipitation of not a NaCl carbonitride (MX compound, wherein M stands for a metal) but a carbonitride composed mainly of Cr and Mo after PWHT makes it possible to satisfy both suppression of the formation of a ferrite band and improvement of toughness. These documents however do not include any consideration on the prevention of SR cracking.

In Japanese Patent No. 3251424 (which will hereinafter be called "Patent Document 3"), described is a weld wire for high hardness Cr—Mo steels for obtaining a weld metal excellent in toughness and various cracking resistances including SR cracking resistance after PWHT. According to this document, the strength of the weld metal is adjusted to be equal to that of a base metal by adding an adequate amount of V and Nb which are precipitation hardening elements and at the same time, the amounts of Ni, Al an N are controlled in order to prevent an excessive increase in the strength and deterioration of toughness of the weld metal. Moreover, the amounts of P, Sn, Sb and As are controlled from the viewpoint of SR cracking resistance, while an adequate amount of 0 is added and adequate amounts of Ti and B are added for improving the toughness.

In Japanese Patent No. 3283763 (which will hereinafter be called "Patent Document 4"), described are a weld metal for high strength Cr—Mo steels having good toughness and SR cracking resistance, and a submerged arc welding process. SR cracking is prevented by replacing cementite precipitated in a prior austenite grain boundary in the weld metal by a carbide ($M_7C_3$ or $M_{23}C_6$, in which M represents a metal) other than cementite. The composition of the weld metal and SR conditions are therefore appropriately controlled.

DISCLOSURE OF THE INVENTION

As described, various technologies for improving weld materials such as wires and weld metals have been proposed for the purpose of preventing deterioration of toughness and occurrence of SR cracking, which will otherwise occur owing to the generation of a ferrite band, but there is a demand for further improvement.

Moreover, there is an eager demand, in view of a weld efficiency, for the provision of a technology for improving the above-described properties of a weld metal formed using a gas shielded arc welding process among various welding processes. In particular, the provision of a technology for improving the above-described properties of a weld metal formed using a core containing flux (mineral powders) by a gas shielded arc welding process is eagerly requested in view of the welding activity. Wires for gas shielded arc welding are roughly classified into flux-cored wires and solid wires. The reason why the former ones are preferred is that they have various advantages over solid wires such as production of less spatter and better welding activity not only at flat position but also horizontal position and overhead position.

With the foregoing in view, the present invention has been completed. An object of the present invention is to provide a weld metal for Cr—Mo steels which produces fewer ferrite bands, and therefore has increased toughness and tensile strength and at the same time, has good SR cracking resistance.

Another object of the present invention is to provide a weld metal formed using the gas shielded arc welding process and having improved in the above-described properties.

A further object of the present invention is to provide a weld metal formed by a flux-cored wire for gas shielded arc welding and having improved in the above-described properties.

The gist of the invention which has solved the above-described problems resides in a weld metal excellent in toughness and SR cracking resistance, which comprises 0.02 to 0.06% (mass %, which will equally apply hereinafter) of C, 0.1 to 1.0% of Si, 0.3 to 1.5% of Mn, 2.0 to 3.25% of Cr, 0.8 to 1.2% of Mo, 0.010 to 0.05% of Ti, 0.0005% or less (inclusive of 0%) of B, 0.002 to 0.0120% of N, 0.03 to 0.07% of O, and the balance being Fe and inevitable impurities, wherein a ratio of the Ti content [Ti] to the N content [N] satisfies the following range: $2.00<[Ti]/[N]<6.25$.

In a preferred mode, the weld metal further comprises 0.01% or less (exclusive of 0%) of Nb and/or 0.03% (exclusive of 0%) or less of V.

In a preferred mode, the weld metal has a P content suppressed to 0.012% or less (exclusive of 0%) and has an S content suppressed to 0.012% or less (exclusive of 0%).

The present invention embraces a welded structure comprising any one of the above-described weld metal.

According to the present invention, among the carbides precipitated in the prior austenite grains, an amount of MC carbides such as TiC has decreased, while that of very small $M_2C$ carbides including Ti has increased. As a result, the strength in the prior austenite grains and that in the prior austenite grain boundaries are controlled to be almost equal, whereby a weld metal for Cr—Mo steels producing less ferrite bands, having improved toughness and tensile strength, and having excellent SR cracking resistance can be obtained.

BRIEF DESCRIPTION OF THE DRAWINGS

Exemplary embodiment of the present invention will be described in detail based on the following figures, wherein.

PREFERRED EMBODIMENT OF THE INVENTION

Figure 1A:
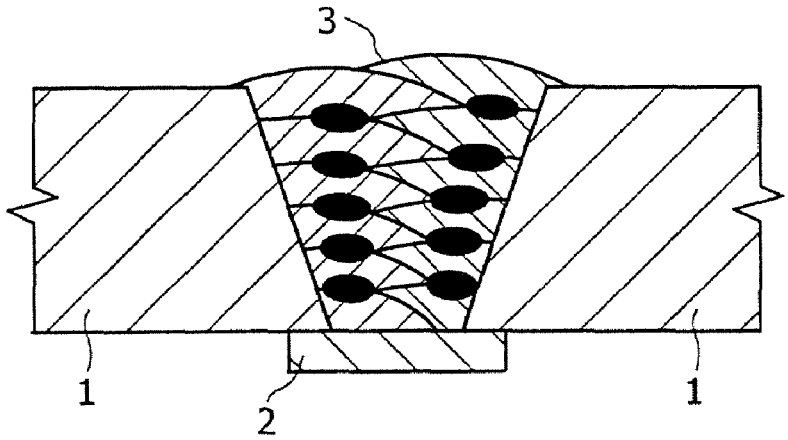
FIG. 1A illustrates ferrite bands which have appeared in a weld metal by PWHT.
Figure 1B:
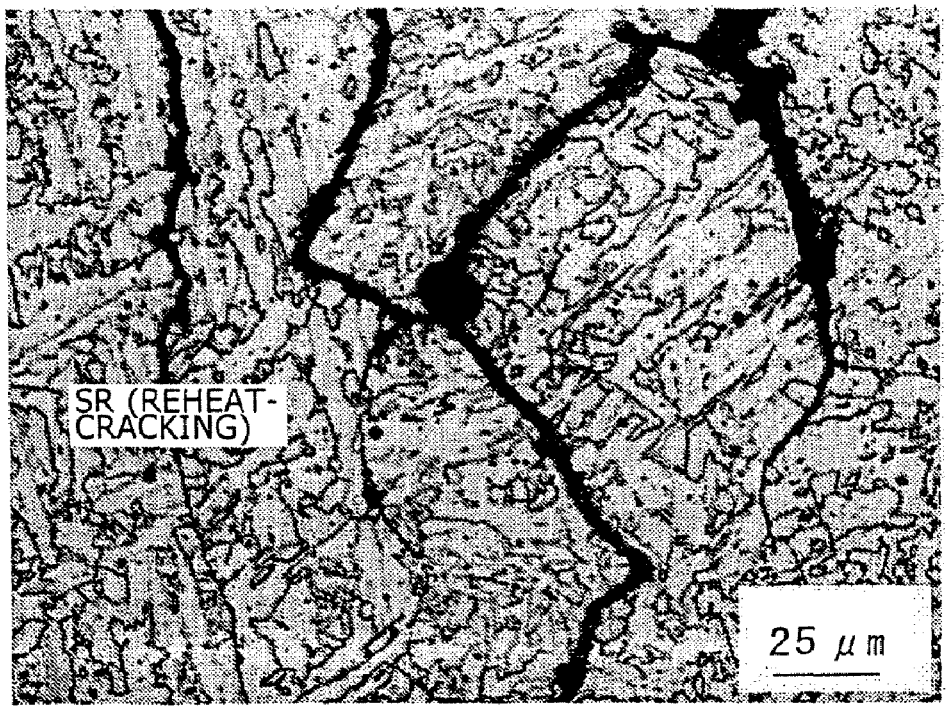
FIG. 1B illustrates SR cracking which has appeared in a weld metal by PWHT.

The present inventors have proceeded with an investigation, paying attention to, of various carbides (carbides between a metal M and carbon C) precipitated in matrix (prior austenite) grains at the time of PWHT, very small carbides (MC carbides and $M_2C$ carbides) in order to prevent both deterioration of toughness and the like, which will otherwise occur by the formation of ferrite bands, and occurrence of SR cracking. As a result, it has been found that a weld metal having desired properties is available by reducing the amount of fine MC carbides composed mainly of Nb and V and increasing the amount of fine $M_2C$ carbides composed mainly of Mo and Cr and further containing Ti. It has also been found that the Ti and N contents, a ratio of the Ti content to the N content ([Ti]/[N] which may be represented by a value P) and the B content in the weld metal must all be controlled properly in order to precipitate such $M_2C$ carbides in the weld metal and when any one of these conditions is outside the predetermined range, the above-described carbides and then, a desired weld metal cannot be obtained, leading to the completion of the invention.

A difference between the $M_2C$ carbides in the present invention and those in a conventional weld metal for Cr—Mo steels lies in that the former ones contain not only Cr and Mo but also Ti. In order to distinguish these two carbides each other, $M_2C$ carbides in the invention and the conventional $M_2C$ carbides may be called "Ti-containing $M_2C$ carbides" and "Ti-free $M_2C$ carbides", respectively.

$M_2C$ carbides will next be described more specifically.

Considering that the formation of SR cracks mainly owes to a difference between the strength in the prior austenite grains and the strength in the prior austenite grain boundaries, the present inventors paid particular attention to carbides precipitated in the prior austenite grains and made a test.

In the prior austenite grains in the weld metal for Cr—Mo steels, fine MC carbides composed mainly of Ti, Nb and V have usually been precipitated and they contributed to the reinforcement in the grains. The present inventors therefore tried to reduce the amount of the MC carbides in the prior austenite grains, thereby suppressing an increase in the strength in the prior austenite grains (which will result in a reduction in the difference from the strength of the prior austenite grain boundaries). It has however been elucidated that a reduction in the amount of MC carbides tends to cause generation of a ferrite band, leading to deterioration in toughness.

The present inventors proceeded with further investigation based on the above-described test results. As a result, it has been found that deterioration in the toughness due to a reduction in the amount of MC carbides can be compensated by an increase in the amount of fine $M_2C$ carbides (Ti-containing $M_2C$ carbides) containing Ti and this makes it possible to satisfy both the prevention of SR cracking and prevention of the formation of ferrite bands.

Based on the above-described findings, the present inventors pursued a method of promoting the formation of Ti-containing $M_2C$ carbides. In the present invention, the MC carbides are presumed to be substantially made of TiC because the contents of V and Nb in the weld metal are as trace as impurities or are reduced to the utmost.

As a result, it has been revealed that the formation of Ti-containing $M_2C$ carbides is in competition with the formation of MC carbides typified by TiC, meaning that an increase in the formation amount of MIC carbides disturbs the formation of Ti-containing $M_2C$ carbides. It has also been revealed that the amount of the Ti-containing $M_2C$ carbides largely depends on the Ti and N contents in the weld metal and a ratio (value P) of the Ti content to the N content, and desired $M_2C$ carbides cannot be prepared without controlling all of these factors properly. As described later in Examples, these factors, when they are outside the specified ranges, may lead to inevitable formation of $M_2C$ carbides free of Ti and composed mainly of Cr and Mo or inevitable formation of coarse $M_2C$ carbides. Thus, the weld metal thus obtained does not effectively exhibit desired properties. For example, when the Ti content is large as described in Patent Document 1 or 2, most of the MC carbides thus formed are made of TiC and the desired Ti-containing $M_2C$ carbides are not formed.

It has also been revealed that a reduction in the B content in the weld metal as much as possible is desired in order to avoid the influence of B on the formation of MC carbides. As described above referring to the four patent documents, B is added positively for the purpose of utilizing the toughness improving action of free B. An excess amount of B is however coupled with a solid solution N to form BN. An amount of a solid solution Ti increases with a decrease in the amount of the solid solution N, which increases an amount of harmful MC carbides. The upper limit of the content B is therefore set in the invention.

As a result of many fundamental tests made based on the above-described viewpoints, the contents of Ti, N, and B are adjusted to fall within ranges of Ti: 0.010 to 0.05%, N, 0.002 to 0.0120% and B: 0.0005% or less, and at the same time, the value P is adjusted to fall within a range of 2.00 to 6.25.

In the above-described Patent Documents 2 and 4, similar to the present invention, attention is paid to carbides in the weld metal and prevention of generation of ferrite bands (Patent document 2) and prevention of SR cracking (Patent document 4) are intended. They are however different from the present invention in the technical concept and constitution as described below. As described above, the weld metal in Patent document 1 is mainly for Cr—Mo steels containing approximately 1.3% of Cr and they are, in a precise sense, different in a range of the amount of Cr from the Cr—Mo steels in the present invention, but they are compared just in case.

The technical concept of Patent Document 2 resides in that prevention of the formation of ferrite bands and improvement of toughness are simultaneously attained by precipitating a compound (corresponding to $M_2X$ compound) composed mainly of Cr and Mo instead of an MX compound such as TiC which deteriorates the toughness. It is different from that of the present invention which resides in precipitation of fine $M_2X$ carbides containing Ti.

In addition, in Patent Document 2, similar to the present invention, the balance among the contents of Ti, N and B are controlled while limiting the contents of Nb and V in order to precipitate the above-described compound. The contents of Ti, N and B are adjusted to ranges of Ti: greater than 0.035 to 0.020%, N: 0.006 to 0.030% and B: 0.0005 to 0.020%, which are however higher than the ranges of the present invention. Thus, the above-described invention is different from the present invention in the constitution.

Patent Document 4 pays attention to coarse carbides at the prior austenite grain boundaries. According to the technical concept thereof, amounts of coarse carbides such as $M_7C_3$ and $M_{23}C_6$ are increased in reverse proportion to the amount of cementite. It does not however include the technical concept of the present invention in which with attention paid to fine carbides in the prior austenite grains, the formation of fine Ti-containing $M_2C$ carbides is promoted instead of decreasing an amount of MC carbides.

In Patent Document 4, the Ti content in the weld metal, which will deteriorate the toughness thereof, is reduced as much as possible and in its Example, the Ti content is reduced to 0.007% or less. It is thus different in the constitution from that of the present invention in which Ti is added in an amount of 0.10% or greater. When the amount of Ti is small as described in Patent Document 4, $M_2C$ carbides, if prepared any, become coarse with an increase in diameter, which coarsens ferrite bands, thereby deteriorating toughness. In addition, when the Ti content in the weld metal is small, Ti is not introduced into the $M_2C$ carbides and useful carbides contributing to prevention of SR cracking and prevention of the formation of ferrite bands are not available.

(Weld Metal of the Present Invention)

Components featuring the weld metal of the present invention will next be described specifically.

In the present invention, as described above, the Ti, N, and B contents are adjusted to Ti: 0.010 to 0.05%, N, 0.002 to 0.0120% and B: 0.0005% or less, and at the same time, the value P represented by [Ti]/[N] is adjusted to fall within 2.00 to 6.25. As described later in Examples, any one of the Ti and N contents outside the above-described ranges, the B content exceeding the above-described range and the value P outside the above-described range makes it difficult to achieve both the prevention of SR cracking and prevention of deterioration in toughness.

Ti: 0.01 to 0.05%

Ti is an element which is coupled with carbon and nitrogen and forms an MC carbonitride. In the present invention, as described above, SR cracking is prevented and at the same time, deterioration in toughness due to generation of ferrite bands is prevented by controlling the Ti content appropriately to reduce the amount of MC carbides such as TiC while increasing the amount of fine $M_2C$ carbides containing Ti. As described later in Examples, a small Ti content may lead to occurrence of SR cracking even if the value P is adjusted to fall within a predetermined range. A large Ti content, on the other hand, may cause SR cracking and deteriorate the toughness because it is accompanied by an increase in the value P and the amount of MC carbides. The preferred range of Ti can be determined, depending on the balance with the N content and the like, but it is roughly 0.020% or greater but not greater than 0.045%.

N: 0.002 to 0.0120%

N is an element which is coupled with Ti, Nb and B and forms a nitride. In the present invention, the amount of MC carbides is reduced and that of desired Ti-containing $M_2C$ carbides is increased by properly controlling the N content. When the N content is small, SR cracking occurs even if the P value is controlled to fall within a predetermined range. When the N content is large, on the other hand, coarse $M_2C$ carbides are formed, which may cause SR cracking and deterioration of toughness. The preferred range of the N content can be determined, depending on the balance with the Ti content and the like, but is roughly 0.004% or greater but not greater than 0.011%.

$2.00<[Ti]/[N]$ (=P Value)$<6.25$

The P value is a parameter which will be an indicator determining the balance between MC carbides and $M_2C$ carbides. When a ratio of [Ti] to [N] becomes small and the P value falls below 2.00, desired Ti-containing $M_2C$ carbides are not formed and SR cracking occurs even if the Ti content and N content each satisfies the range of the present invention. When a ratio of [Ti] to [N] becomes large and the P value exceeds 6.25, on the other hand, desired Ti-containing $M_2C$ carbides are not formed and not only SR cracking but also deterioration in toughness may occur even if the Ti content and N content each satisfies the range of the present invention. The preferred range of the P value is determined, depending on the balance between the Ti content and N content, but it is roughly 3.00 or greater but not greater than 6.00.

B: 0.0005% or Less (Inclusive of 0%)

B is an element having an influence on the formation of MC carbides. When the B content is large, the amount of MC carbides increases and SR cracking occurs so that it is set at 0.0005% or less in the present invention. Described specifically, an excess amount of B in the weld metal is coupled with the solid solution N to form BN. A reduction in the amount of the solid solution N causes an increase in the amount of the solid solution Ti, leading to an increase in the amount of MC carbides. By setting the upper limit of the B content as described above, the formation of the desired Ti-containing $M_2C$ carbide is promoted and SR cracking is prevented. The B content is preferably as small as possible and for example, is preferably 0.0003% or less.

The weld metal of the present invention is characterized in that the Ti, N, and B contents and P value are each adjusted to fall within the above-described range. No particular limitation is imposed on the amounts of the other components insofar as they are within the defined ranges of Cr—Mo steels. Specific ranges will next be described.

C: 0.02 to 0.06%

C is an element indispensable for assuring the strength of a weld metal and it is added in an amount of 0.02% or greater. An excess amount of C increases a hard structure such as martensite and deteriorates toughness so that the upper limit of the C content is set at 0.06%. The C content is preferably 0.03% or greater but not greater than 0.05%.

Si: 0.1 to 1.0%

Si is an element which acts as a deoxidizing agent of a weld metal. A small Si content leads to lowering in strength. Addition of an excess amount of Si, on the other hand, causes a marked increase in the strength and also an increase of a hard structure such as martensite so that the resulting weld metal has deteriorated toughness. With the foregoing in view, the Si content is set at 0.1 to 1.0% in the present invention. The Si content is preferably 0.2% or greater but not greater than 0.8%.

Mn: 0.3 to 1.5%

Mn is an element useful for assuring the strength and toughness of a weld metal. It is therefore added in an amount of 0.3% or greater. Addition of an excess amount of it causes a marked increase in hardenability or an increase in a hard structure such as martensite due to segregation of Mn, resulting in deterioration of toughness. The upper limit is therefore set at 1.5%. The Mn content is preferably 0.5% or greater but not greater than 1.2%.

Cr: 2.0 to 3.25%

Cr is one of the essential elements of heat-resistant Cr—Mo steels and contributes to ensuring of strength. Addition of an excess amount of it not only deteriorates the toughness owing to heightening of hardenability but also a large amount of coarse $M_{23}C_6$ carbides is formed in prior austenitic grain boundaries and promotes SR cracking. With the foregoing in view, the Cr content is set in a range of 2.0 to 3.25%. The Cr content is preferably 2.1% or greater but not greater than 3.0%.

Mo: 0.8 to 1.2%

Mo is, similar to Cr, one of the essential components of heat-resistant Cr—Mo steels and is an element which contributes to ensuring of strength. Addition of an excess amount of it not only causes deterioration of toughness owing to heightening of hardenability but also causes SR cracking. With the foregoing in view, the Mo content is set in a range of 0.8 to 1.2%. The Mo content is preferably 0.9% or greater but not greater than 1.1%.

O: 0.03 to 0.07%

O is an element forming an oxide which will be a transformation structure (acicular ferrite formation nucleus) in the prior austenite grains and contributing to the improvement of toughness owing to the miniaturization of the structure. When an excess amount of O is added, however, a large amount of the alloy element is consumed as an oxide and a reduction in the strength occurs. In addition, a reduction in toughness occurs. With the foregoing in view, the O content is set in a range of 0.03 to 0.07%. The 0 content is preferably 0.04% or greater but not greater than 0.06%.

The weld metal of the present invention contains the above-described components and, has Fe and inevitable impurities as the balance.

In the present invention, the amounts of the below-described components are preferably controlled in order to prevent SR cracking or deterioration in toughness more effectively.

Nb: 0.01% or Less (Exclusive of 0%) and/or V: 0.03% or Less (Exclusive of 0%)

Nb and V are each an element contributing to the improvement of strength and V, for example, is added preferably in an amount of 0.01% or greater to improve the strength. These elements may be added singly or in combination. Addition of an excess amount of them however promotes the formation of MC carbides, whereby SR cracking occurs and toughness lowers. To avoid them, the upper limit of the Nb and V contents are preferably adjusted to Nb: 0.01% and V: 0.03%. The Nb content is preferably 0.005% or less, while the V content is preferably 0.02% or less.

P: 0.012% or Less (Exclusive of 0%)

The P content is preferably adjusted to 0.012% or less because it segregates as an impurity in the prior austenite grain boundary and causes deterioration of toughness or SR cracking. The smaller the P content, the better. The P content is more preferably adjusted to 0.010% or less, still more preferably 0.008% or less.

S: 0.012% or Less (Exclusive of 0%)

The S content is preferably adjusted to 0.012% or less because it segregates as an impurity in the prior austenitic grain boundary and causes deterioration of toughness or SR cracking. The smaller the S content, the better. The S content is more preferably adjusted to 0.010% or less, still more preferably 0.008% or less.

The weld metal of the present invention was so far described above.

(Manufacturing Process of Weld Metal)

Next, a method of obtaining the above weld metal will be explained.

The weld metal of the present invention can be obtained by properly controlling welding conditions such as composition or groove shape of the base material (steel material), composition of weld material (wire), welding current, welding voltage, wire extension and welding process.

With regard to the welding process, it is preferred to weld a flux-cored wire to a base material (steel material) by gas shielded arc welding in consideration of the welding activity and practical utility. In particular, a desired weld metal is available in the present invention by properly controlling the Ti, N and B contents in the flux-cored wire. The chemical composition of the weld metal is usually influenced by a weld material such as wire and moreover by the dilution with the base material, but they have little influence on the chemical position when gas shielded arc welding is employed.

A description will next be made of a preferred welding process using a flux-cored wire in accordance with gas shielded arc welding (FCAW). It should however be noted that the present invention is not limited to it. Any welding process such as shielded metal arc welding (SMAW), tig (TIG) welding, submerged arc welding (SAW) and gas shielded arc welding (MAG, MIG) can be employed.

The preferred composition of the flux-cored wire to be used in the present invention varies, depending on the welding conditions, but in particular, the Ti, N and B contents are preferably controlled as described below. This makes it possible to obtain a desired weld metal.

Ti: 0.010 to 0.10% (more preferably, 0.03 to 0.08%)

N: 0.002 to 0.013% (more preferably, 0.005 to 0.012%)

[Ti]/[N]=(P value): greater than 3.00 but less than 10.00 (more preferably 4.00 to 8.00)

B: 0.0005% or less (exclusive of 0%) (more preferably, 0.0004% or less)

The weld metal contains, other than the above-described components, C: 0.02 to 0.08% (more preferably 0.03 to 0.07%), Si: 0.10 to 1.5% (more preferably 0.3 to 1.3%), Mn: 0.3 to 1.5% (more preferably 0.5 to 1.25%), Cr: 2.0 to 3.60% (more preferably 2.1 to 3.50%), and Mo: 0.8 to 1.2% (more preferably 0.9 to 1.1%), and has Fe and inevitable impurities as the balance.

It is more preferred to adjust the Nb content to 0.01% or less (more preferably 0.005% or less) and/or the V content to 0.03% or less (more preferably, 0.02% or less) in order to prevent SR cracking or prevent deterioration of toughness more effectively.

In a similar viewpoint to that described above, it is preferred to adjust the P content to 0.012% or less (more preferably 0.010% or less) and the S content to 0.012% or less (more preferably 0.010% or less).

Moreover, the amount of strong deoxidizing elements (Mg, Al and the like) is preferably adjusted to fall within a range of approximately 0.50 to 0.85% (more preferably 0.6 to 0.7%) in order to properly control the 0 content in the weld metal.

The flux-cored wire to be used in the present invention may contain another component such as Cu, Ni, Co or W in an amount within such a range as not to damage the effect of the present invention, depending on the performance which a welded material (base material) is required to have.

No particular limitation is imposed on the composition of the flux insofar as it is usually employed. It is preferably composed mainly of, for example, rutile.

A flux filling ratio of the flux-cored wire is not particularly limited and can be determined in consideration of the productivity of the wire, for example, disconnection at the time of molding or wire drawing. The flux filling ratio is preferably within a range of 11.0 to 18.0%, though roughly.

No particular limitation is imposed on the cross-sectional shape of the wire and it may be either seamed or seamless. When the cross-sectional shape of the wire is seamless, Cu plating or Ni plating or composite plating thereof may be given to the surface of the wire in order to improve the wire feeding property.

No particular limitation is imposed on the preferable composition of a steel material to be used in the present invention insofar as it falls within a defined range for Cr—Mo steels. Examples include ASTM A387-Gr. 22 Cl. 2 (2.25Cr-0.5Mo). In the present invention, the base material preferably has a substantially similar composition to that of the weld metal.

No particular limitation is imposed on the process employed for gas shielded arc welding and an ordinarily employed process is usable.

As a shielding gas, a mixed gas of Ar gas and $CO_2$ gas, a mixed gas of Ar gas and $O_2$ gas, and a mixed gas of three gases, that is, Ar gas, $CO_2$ gas and $O_2$ gas can be used as well as 100% $CO_2$ gas.

EXAMPLES

The present invention will hereinafter be described more specifically by Examples. It should however be borne in mind that the present invention is not limited by these Examples and can be modified within such a range as not to depart from the gist of the present invention. Any of the modifications may be embraced within the technological range of the present invention. In all designations in the below-described Examples, "%" and "part" or "parts" mean "mass %" and "part by mass" or "parts by mass unless otherwise specifically indicated.

Example 1

Flux-Cored Wire and Base Material

Figure 2:
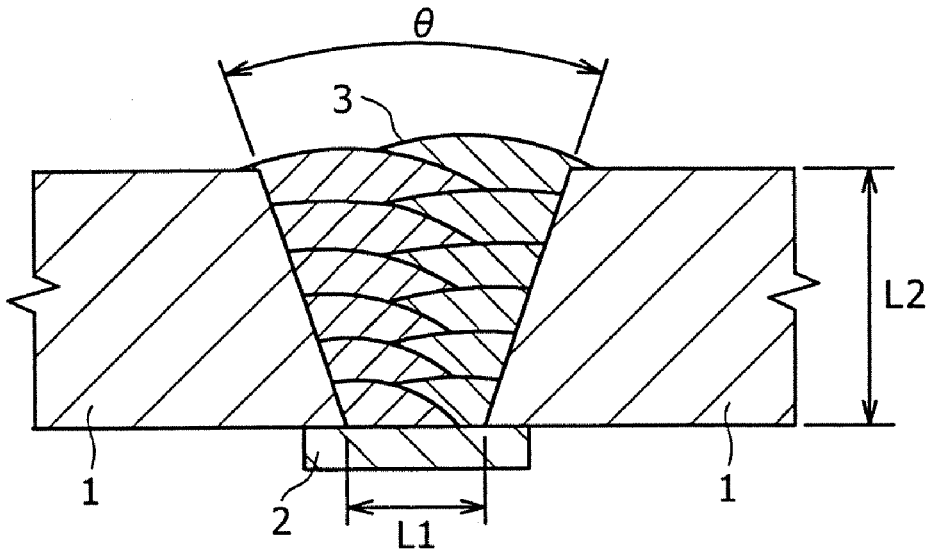
FIG. 2 illustrates a groove shape of a steel plate used in Examples.

In this Example, flux-cored wires W1 to W37 shown in Table 1 and a Cr—Mo heat-resistant low-alloy steel plate (weld base material) 1 having a groove (V-shaped groove with θ=45°) shown in FIG. 2 were prepared.

The flux-cored wires W1 to W37 each had a wire diameter of 1.2 mm and a filling ratio of the flux in the flux-cored wire is approximately 13 to 15%.

The steel plate 1 shown in FIG. 2 has a thickness of 19 mm and has a composition as shown in Table 2 (balance: Fe and inevitable impurities). The steel plate has, at the lower portion of the V-shaped groove thereof, a backing plate 2 having a similar chemical composition to that of the weld base material 1. A gap width (root gap) L1 at the portion where the backing plate has been disposed is set at 13 mm.

(Welding Conditions)

But welding of the steel plate shown in FIG. 2 was performed by gas shielded arc welding using the above-described flux-cored wire. The specific welding conditions are shown below.

Welding current: 270 A

Arc voltage: 30 to 32V

Welding speed: 30 cm/min

Position of weld: flat position welding

Composition and flow rate of shielding gas: $CO_2$ 100%, 25 L/min

Preheating/interpath temperature: 17.5±15° C.

The welding was followed by PWHT treatment (treatment at 690° C. for 1 hour and then furnace-cooling was performed). A weld metal 3 after welding is schematically illustrated in FIG. 2.

(Evaluation)

(Composition of Weld Metal)

The composition of the weld metal at the center portion thereof was examined after PWHT.

(Confirmation of MC Carbides and $M_2C$ Carbides in the Weld Metal)

The central portion of the final path of the weld metal after PWHT was observed by TEM (transmission electron microscope) by using the extraction replica technique (×30000) and MC carbides and $M_2C$ carbides were observed. Described specifically, after these carbides in a certain region (4.67 μm×3.67 μm) were distinguished based on the electron diffraction patterns obtained by the TEM observation, EDX (energy dispersion X-ray analysis) was performed to analyze their compositions to confirm the presence or absence of MC carbides and $M_2C$ carbides.

(Evaluation of Tensile Properties)

Using a tensile test specimen (JIS Z3111 No. A1) obtained from the center portion of a weld metal in a weld line direction, tensile tests were performed. Three tensile test specimens were collected from one weld metal and tensile strength (TS) and yield stress (YS) were each determined as an average of these three test specimens.

In this Example, a weld metal having YS of 550 MPa or greater is rated as "excellent in mechanical properties".

(Evaluation of Toughness)

Charpy impact tests were performed using a Charpy impact test specimen (JIS Z3111 No. 4) obtained from the center portion of each weld metal in a direction perpendicular to the weld line. Three Charpy impact test specimens were obtained from one weld metal and a Charpy impact value ($vE_{-18}$) was determined as an average of them. The Charpy impact value is an absorption energy measured at −18° C.

In this Example, a weld metal having $vE_{-18}$ of 70 J or greater was evaluated as "excellent in toughness".

(Presence or Absence of Ferrite Bands)

Figure 3:
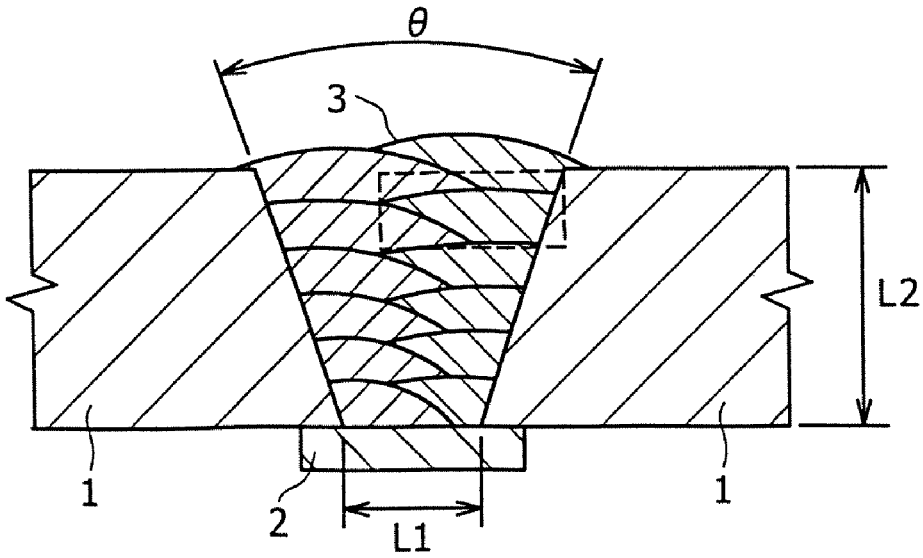
FIG. 3 illustrates the position at which presence or absence of occurrence of ferrite bands is studied.

As illustrated in FIG. 3, six test specimens of 6×12 mm in size were obtained from a weld metal portion after PWHT at equal intervals in a weld line direction. After these test specimens were each subjected to mirror polishing and etching with 2% nital, the presence or absence of ferrite bands was observed by an optical microscope (×50). In this Example, when all of the six test specimens had no ferrite band, the weld metal was evaluated as qualified (○) and when any one of the six test specimens had a ferrite band, the weld metal was evaluated as disqualified (X).

(Evaluation of SR Cracking Resistance)

SR cracking resistance was evaluated by obtaining a cylindrical test specimen as illustrated in FIG. 4 from an as-welded steel plate (not subjected to PWHT) and carrying out a ring fracture test.

Figure 4A:
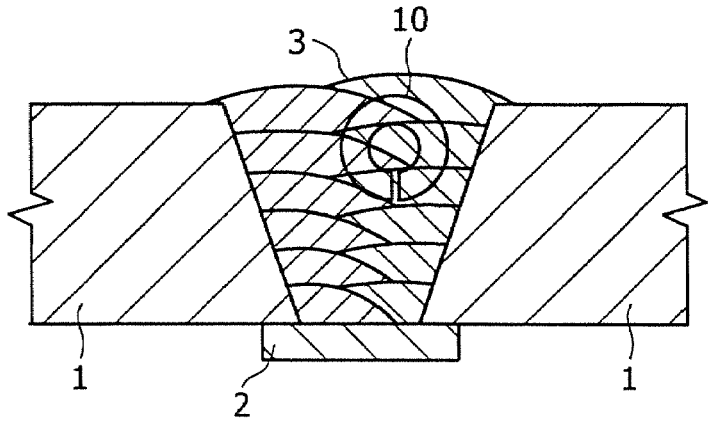
FIG. 4A is a cross-sectional view illustrating the position at which a cylindrical test specimen used for evaluation of SR cracking resistance is collected.
Figure 4B:
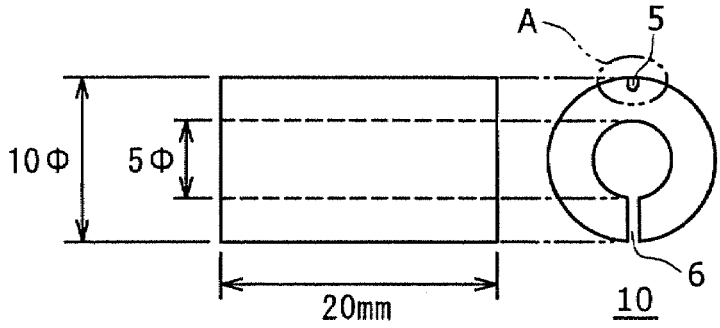
FIG. 4B is a cross-sectional view illustrating the shape of the cylindrical test specimen employed for the evaluation of SR cracking resistance.
Figure 4C:
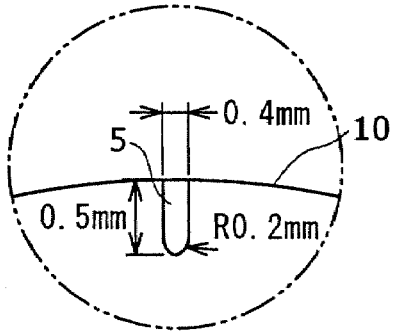
FIG. 4C is a schematic view of the cylindrical test specimen of FIG. 4A or FIG. 4B.

As illustrated in FIG. 4A, a cylindrical test specimen 10 as illustrated in FIG. 4B was obtained from the upper portion of the final bead of the weld metal 3. The details of the cylindrical test specimen 10 are as illustrated in FIG. 4C. The cylindrical test specimen 10 has a U notch 5 and a slit 6 extending to the hollow inside of the cylinder. The U notch 5 is located at the upper portion of an unaffected zone of the weld metal 3, while the slit 6 is located at the lower portion of the unaffected zone of the weld metal 3. The U notch 5 is in the form of a U-shaped trench with a depth of 0.5 mm, width of 0.4 mm and a curvature radius, at the bottom of the notch, of 0.2 mm. The slit 6 has a width of 0.5 mm.

A ring fracture test was then performed using the cylindrical test specimen 10.

Figure 4D:
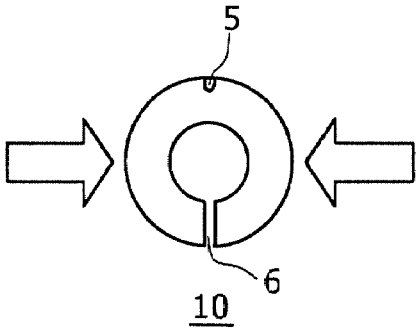
FIG. 4D is a cross-sectional view illustrating a ring cracking test using the cylindrical test specimen.

The ring fracture test was performed with reference to "Research on stress relief annealing crack (second report)" (by Uchiki, et al., *Journal of the Japan Welding Society,* 33 (9), 718 (1964)). Described specifically, as illustrated in FIG. 4D, the slit 6 of the cylindrical test specimen 10 was welded by TIG welding without adding a weld material while applying a bending stress to the test specimen in a direction of an arrow. A tensile residual stress was then applied to the U notch portion 5, under which PWHT treatment similar to that described above was performed. After PWHT, three cross-sections of the ring were observed by an optical microscope (×100). When any of these three cross-sections did not show an evidence of cracks at the bottom of the U notch 5, the test specimen was rated as ○ (qualified) because SR cracking was prevented (SR cracking resistance was excellent). When any of these three cross-sections showed an evidence of cracks, on the other hand, the test specimen was rated as X (disqualified) because SR cracking occurred (SR crack resistance was inferior).

These results are shown collectively in Tables 3 and 4.

TABLE 1

| No. | C | Si | Mn | Cr | Mo | Ti | B | N | Ti/N (=P value) | Nb | V | Mg |
|---|---|---|---|---|---|---|---|---|---|---|---|---|
| W1 | 0.06 | 0.50 | 0.88 | 2.44 | 1.00 | 0.07 | 0.0004 | 0.009 | 7.44 | 0.013 | 0.039 | 0.7 |
| W2 | 0.04 | 0.36 | 1.25 | 2.78 | 1.02 | 0.06 | 0.0006 | 0.010 | 6.41 | 0.017 | 0.037 | 0.7 |
| W3 | 0.08 | 0.33 | 0.88 | 2.44 | 1.06 | 0.07 | 0.0002 | 0.010 | 7.16 | 0.012 | 0.036 | 0.7 |
| W4 | 0.06 | 0.21 | 1.00 | 2.33 | 1.01 | 0.08 | 0.0004 | 0.009 | 8.07 | 0.013 | 0.034 | 0.7 |
| W5 | 0.05 | 1.21 | 1.00 | 2.48 | 1.02 | 0.07 | 0.0002 | 0.010 | 7.43 | 0.013 | 0.038 | 0.7 |
| W6 | 0.06 | 0.49 | 0.50 | 2.78 | 1.00 | 0.07 | 0.0004 | 0.010 | 7.00 | 0.017 | 0.039 | 0.7 |
| W7 | 0.06 | 0.50 | 1.75 | 2.67 | 1.03 | 0.07 | 0.0002 | 0.010 | 6.75 | 0.012 | 0.040 | 0.7 |
| W8 | 0.05 | 0.47 | 1.00 | 3.56 | 1.05 | 0.06 | 0.0006 | 0.009 | 6.44 | 0.014 | 0.036 | 0.7 |
| W9 | 0.06 | 0.36 | 0.88 | 2.33 | 1.17 | 0.07 | 0.0002 | 0.010 | 6.28 | 0.013 | 0.037 | 0.7 |
| W10 | 0.06 | 0.51 | 1.00 | 2.22 | 0.99 | 0.03 | 0.0002 | 0.009 | 3.54 | 0.016 | 0.039 | 0.7 |
| W11 | 0.05 | 0.50 | 1.13 | 2.33 | 1.04 | 0.08 | 0.0004 | 0.009 | 8.72 | 0.012 | 0.036 | 0.7 |
| W12 | 0.06 | 0.49 | 1.00 | 2.22 | 1.02 | 0.07 | 0.0005 | 0.009 | 7.08 | 0.013 | 0.038 | 0.7 |
| W13 | 0.05 | 0.47 | 1.25 | 2.33 | 0.98 | 0.04 | 0.0004 | 0.005 | 7.87 | 0.012 | 0.039 | 0.7 |
| W14 | 0.05 | 0.47 | 1.25 | 2.33 | 0.98 | 0.04 | 0.0002 | 0.013 | 3.09 | 0.013 | 0.037 | 0.7 |
| W15 | 0.06 | 0.49 | 1.00 | 2.39 | 1.01 | 0.07 | 0.0002 | 0.009 | 7.74 | 0.012 | 0.036 | 0.5 |
| W16 | 0.06 | 0.49 | 1.00 | 2.50 | 1.07 | 0.06 | 0.0004 | 0.010 | 5.57 | 0.006 | 0.039 | 0.7 |
| W17 | 0.04 | 0.43 | 1.25 | 2.56 | 1.07 | 0.08 | 0.0004 | 0.010 | 8.00 | 0.006 | 0.013 | 0.7 |
| W18 | 0.06 | 0.50 | 0.88 | 2.44 | 1.05 | 0.06 | 0.0004 | 0.009 | 6.38 | 0.014 | 0.038 | 0.7 |
| W19 | 0.10 | 0.50 | 0.88 | 2.44 | 1.00 | 0.07 | 0.0004 | 0.009 | 7.44 | 0.016 | 0.040 | 0.7 |
| W20 | 0.05 | 0.06 | 1.25 | 2.33 | 0.98 | 0.04 | 0.0002 | 0.013 | 3.09 | 0.017 | 0.037 | 0.7 |
| W21 | 0.06 | 1.57 | 1.00 | 2.33 | 1.04 | 0.07 | 0.0000 | 0.010 | 6.58 | 0.013 | 0.036 | 0.7 |
| W22 | 0.06 | 0.33 | 2.06 | 2.22 | 1.05 | 0.07 | 0.0002 | 0.009 | 7.63 | 0.016 | 0.039 | 0.7 |
| W23 | 0.06 | 0.49 | 1.00 | 1.39 | 1.04 | 0.06 | 0.0004 | 0.010 | 6.65 | 0.012 | 0.038 | 0.7 |
| W24 | 0.05 | 0.47 | 1.00 | 3.72 | 0.98 | 0.07 | 0.0002 | 0.009 | 7.36 | 0.013 | 0.034 | 0.7 |
| W25 | 0.06 | 0.40 | 0.94 | 2.48 | 0.51 | 0.06 | 0.0000 | 0.009 | 6.28 | 0.017 | 0.039 | 0.7 |
| W26 | 0.06 | 0.50 | 1.00 | 2.67 | 1.53 | 0.07 | 0.0002 | 0.010 | 6.75 | 0.017 | 0.037 | 0.7 |
| W27 | 0.06 | 0.54 | 1.50 | 2.89 | 1.02 | 0.005 | 0.0002 | 0.010 | 0.48 | 0.018 | 0.036 | 0.7 |
| W28 | 0.05 | 0.47 | 1.00 | 2.27 | 1.05 | 0.12 | 0.0001 | 0.014 | 8.62 | 0.016 | 0.038 | 0.7 |
| W29 | 0.06 | 0.36 | 0.88 | 2.33 | 1.17 | 0.07 | 0.0047 | 0.010 | 6.28 | 0.017 | 0.037 | 0.7 |
| W30 | 0.06 | 0.51 | 1.00 | 2.22 | 0.99 | 0.05 | 0.0002 | 0.015 | 3.27 | 0.017 | 0.036 | 0.7 |
| W31 | 0.06 | 0.44 | 1.13 | 2.17 | 0.97 | 0.08 | 0.0004 | 0.009 | 8.72 | 0.016 | 0.034 | 0.3 |
| W32 | 0.06 | 0.46 | 1.00 | 2.22 | 1.02 | 0.03 | 0.0002 | 0.013 | 2.58 | 0.013 | 0.036 | 0.7 |
| W33 | 0.08 | 0.49 | 1.25 | 2.33 | 1.00 | 0.07 | 0.0005 | 0.005 | 14.17 | 0.014 | 0.037 | 0.7 |
| W34 | 0.06 | 0.50 | 0.88 | 2.44 | 1.00 | 0.07 | 0.0004 | 0.009 | 7.44 | 0.026 | 0.013 | 0.7 |
| W35 | 0.06 | 0.50 | 0.88 | 2.44 | 1.00 | 0.07 | 0.0004 | 0.009 | 7.44 | 0.006 | 0.047 | 0.7 |
| W36 | 0.10 | 0.57 | 1.08 | 2.57 | 1.19 | 0.16 | 0.0060 | 0.014 | 11.22 | 0.002 | 0.009 | 0.7 |
| W37 | 0.06 | 0.67 | 1.24 | 2.57 | 1.73 | 0.16 | 0.0048 | 0.015 | 10.24 | 0.002 | 0.008 | 0.7 |

TABLE 2

| C | Si | Mn | Cr | Mo |
|---|---|---|---|---|
| 0.10 | 0.10 | 0.60 | 2.30 | 1.00 |

TABLE 3

| Test No. | Wire No. | Chemical Composition (mass %, balance: iron and inevitable impurities) | | | | | | | | | |
|---|---|---|---|---|---|---|---|---|---|---|---|
| | | C (%) | Si (%) | Mn (%) | Cr (%) | Mo (%) | Ti (%) | B (%) | N (%) | O (%) | Ti/N P Value |
| 1 | W1 | 0.05 | 0.35 | 0.7 | 2.2 | 0.98 | 0.042 | 0.0003 | 0.0080 | 0.04 | 5.25 |
| 2 | W2 | 0.03 | 0.25 | 1.0 | 2.5 | 1.00 | 0.038 | 0.0005 | 0.0084 | 0.05 | 4.52 |
| 3 | W3 | 0.06 | 0.23 | 0.7 | 2.2 | 1.04 | 0.044 | 0.0002 | 0.0087 | 0.05 | 5.06 |
| 4 | W4 | 0.05 | 0.15 | 0.8 | 2.1 | 0.99 | 0.045 | 0.0003 | 0.0079 | 0.06 | 5.70 |
| 5 | W5 | 0.04 | 0.85 | 0.8 | 2.2 | 1.00 | 0.043 | 0.0002 | 0.0082 | 0.05 | 5.24 |
| 6 | W6 | 0.05 | 0.34 | 0.4 | 2.5 | 0.98 | 0.041 | 0.0003 | 0.0083 | 0.05 | 4.94 |
| 7 | W7 | 0.05 | 0.35 | 1.4 | 2.4 | 1.01 | 0.040 | 0.0002 | 0.0084 | 0.06 | 4.76 |
| 8 | W8 | 0.04 | 0.33 | 0.8 | 3.2 | 1.03 | 0.035 | 0.0005 | 0.0077 | 0.05 | 4.55 |
| 9 | W9 | 0.05 | 0.25 | 0.7 | 2.1 | 1.15 | 0.039 | 0.0002 | 0.0088 | 0.05 | 4.43 |
| 10 | W10 | 0.05 | 0.36 | 0.8 | 2.0 | 0.97 | 0.020 | 0.0002 | 0.0080 | 0.06 | 2.50 |
| 11 | W11 | 0.04 | 0.35 | 0.9 | 2.1 | 1.02 | 0.048 | 0.0003 | 0.0078 | 0.05 | 6.15 |
| 12 | W12 | 0.05 | 0.34 | 0.8 | 2.0 | 1.00 | 0.040 | 0.0004 | 0.0080 | 0.04 | 5.00 |
| 13 | W13 | 0.04 | 0.33 | 1.0 | 2.1 | 0.96 | 0.025 | 0.0003 | 0.0045 | 0.04 | 5.56 |
| 14 | W14 | 0.04 | 0.33 | 1.0 | 2.1 | 0.96 | 0.024 | 0.0002 | 0.0110 | 0.05 | 2.18 |
| 15 | W15 | 0.05 | 0.34 | 0.8 | 2.2 | 0.99 | 0.041 | 0.0002 | 0.0075 | 0.07 | 5.47 |
| 16 | W16 | 0.05 | 0.34 | 0.8 | 2.3 | 1.05 | 0.035 | 0.0003 | 0.0089 | 0.04 | 3.93 |
| 17 | W17 | 0.03 | 0.30 | 1.0 | 2.3 | 1.05 | 0.045 | 0.0003 | 0.0088 | 0.05 | 5.11 |
| 18 | W18 | 0.05 | 0.35 | 0.7 | 2.2 | 1.03 | 0.038 | 0.0003 | 0.0075 | 0.04 | 5.07 |

| Test No. | Chemical Composition (mass %, balance: iron and inevitable impurities) | | | | SR Cracking | Ferrite Band | Tensile Properties | | Impact |
|---|---|---|---|---|---|---|---|---|---|
| | Nb (%) | V (%) | P (%) | S (%) | Presence/ Absence | Presence/ Absence | YS MPa | TS MPa | $vE_{-18}$ (J) |
| 1 | 0.012 | 0.035 | 0.008 | 0.011 | ○ | ○ | 613 | 721 | 109 |
| 2 | 0.015 | 0.033 | 0.006 | 0.010 | ○ | ○ | 626 | 783 | 101 |
| 3 | 0.011 | 0.032 | 0.005 | 0.010 | ○ | ○ | 600 | 706 | 102 |
| 4 | 0.012 | 0.031 | 0.010 | 0.009 | ○ | ○ | 560 | 667 | 112 |
| 5 | 0.012 | 0.034 | 0.006 | 0.010 | ○ | ○ | 665 | 782 | 76 |
| 6 | 0.015 | 0.035 | 0.007 | 0.012 | ○ | ○ | 621 | 730 | 100 |
| 7 | 0.011 | 0.036 | 0.006 | 0.011 | ○ | ○ | 655 | 771 | 108 |
| 8 | 0.013 | 0.032 | 0.010 | 0.008 | ○ | ○ | 720 | 847 | 77 |
| 9 | 0.012 | 0.033 | 0.005 | 0.010 | ○ | ○ | 593 | 698 | 82 |
| 10 | 0.014 | 0.035 | 0.010 | 0.011 | ○ | ○ | 562 | 662 | 102 |
| 11 | 0.011 | 0.032 | 0.006 | 0.012 | ○ | ○ | 600 | 698 | 88 |
| 12 | 0.012 | 0.034 | 0.009 | 0.010 | ○ | ○ | 595 | 699 | 105 |
| 13 | 0.011 | 0.035 | 0.010 | 0.012 | ○ | ○ | 596 | 701 | 94 |
| 14 | 0.012 | 0.033 | 0.011 | 0.011 | ○ | ○ | 585 | 704 | 103 |
| 15 | 0.011 | 0.032 | 0.005 | 0.010 | ○ | ○ | 579 | 681 | 80 |
| 16 | 0.005 | 0.035 | 0.009 | 0.012 | ○ | ○ | 625 | 735 | 126 |
| 17 | 0.005 | 0.012 | 0.010 | 0.009 | ○ | ○ | 618 | 727 | 132 |
| 18 | 0.013 | 0.034 | 0.004 | 0.006 | ○ | ○ | 617 | 726 | 122 |

TABLE 4

| Test No. | Wire No. | Chemical Composition (mass %, balance: iron and inevitable impurities) | | | | | | | | | |
|---|---|---|---|---|---|---|---|---|---|---|---|
| | | C (%) | Si (%) | Mn (%) | Cr (%) | Mo (%) | Ti (%) | B (%) | N (%) | O (%) | Ti/N p Value |
| 19 | W19 | 0.08 | 0.35 | 0.7 | 2.2 | 0.98 | 0.042 | 0.0003 | 0.0080 | 0.04 | 5.25 |
| 20 | W20 | 0.04 | 0.04 | 1.0 | 2.1 | 0.96 | 0.024 | 0.0002 | 0.0110 | 0.05 | 2.18 |
| 21 | W21 | 0.05 | 1.10 | 0.8 | 2.1 | 1.02 | 0.039 | 0.0000 | 0.0084 | 0.05 | 4.64 |
| 22 | W22 | 0.05 | 0.23 | 1.7 | 2.0 | 1.03 | 0.042 | 0.0002 | 0.0078 | 0.05 | 5.38 |
| 23 | W23 | 0.05 | 0.34 | 0.8 | 1.3 | 1.02 | 0.038 | 0.0003 | 0.0081 | 0.06 | 4.69 |
| 24 | W24 | 0.04 | 0.33 | 0.8 | 3.4 | 0.96 | 0.040 | 0.0002 | 0.0077 | 0.05 | 5.19 |
| 25 | W25 | 0.05 | 0.28 | 0.8 | 2.2 | 0.50 | 0.035 | 0.0000 | 0.0079 | 0.05 | 4.43 |

TABLE 4-continued

| | | | | | | | | | | | |
|---|---|---|---|---|---|---|---|---|---|---|---|
| 26 | W26 | 0.05 | 0.35 | 0.8 | 2.4 | 1.50 | 0.040 | 0.0002 | 0.0084 | 0.06 | 4.76 |
| 27 | W27 | 0.05 | 0.38 | 1.2 | 2.6 | 1.00 | 0.003 | 0.0002 | 0.0088 | 0.05 | 0.34 |
| 28 | W28 | 0.04 | 0.33 | 0.8 | 2.0 | 1.03 | 0.070 | 0.0001 | 0.0115 | 0.05 | 6.09 |
| 29 | W29 | 0.05 | 0.25 | 0.7 | 2.1 | 1.15 | 0.039 | 0.0040 | 0.0088 | 0.05 | 4.43 |
| 30 | W30 | 0.05 | 0.36 | 0.8 | 2.0 | 0.97 | 0.030 | 0.0002 | 0.0130 | 0.06 | 2.31 |
| 31 | W31 | 0.05 | 0.31 | 0.9 | 2.0 | 0.95 | 0.048 | 0.0003 | 0.0078 | 0.08 | 6.15 |
| 32 | W32 | 0.05 | 0.32 | 0.8 | 2.0 | 1.00 | 0.020 | 0.0002 | 0.0110 | 0.05 | 1.82 |
| 33 | W33 | 0.06 | 0.34 | 1.0 | 2.1 | 0.98 | 0.040 | 0.0004 | 0.0040 | 0.05 | 10.00 |
| 34 | W34 | 0.05 | 0.35 | 0.7 | 2.2 | 0.98 | 0.042 | 0.0003 | 0.0080 | 0.04 | 5.25 |
| 35 | W35 | 0.05 | 0.35 | 0.7 | 2.2 | 0.98 | 0.042 | 0.0003 | 0.0080 | 0.04 | 5.25 |
| 36 | W36 | 0.08 | 0.40 | 0.9 | 2.3 | 1.17 | 0.095 | 0.0051 | 0.0125 | 0.05 | 7.60 |
| 37 | W37 | 0.05 | 0.47 | 1.0 | 2.3 | 1.70 | 0.094 | 0.0041 | 0.0130 | 0.05 | 7.23 |

| | Chemical Composition (mass %, balance: iron and inevitable impurities) | | | | SR Cracking | Ferrite Band | Tensile Properties | | Impact |
|---|---|---|---|---|---|---|---|---|---|
| Test No. | Nb (%) | V (%) | P (%) | S (%) | Presence/ Absence | Presence/ Absence | YS MPa | TS MPa | $vE_{-18}$ (J) |
| 19 | 0.014 | 0.036 | 0.006 | 0.010 | ○ | ○ | 638 | 750 | 48 |
| 20 | 0.015 | 0.033 | 0.005 | 0.009 | ○ | ○ | 541 | 636 | 108 |
| 21 | 0.012 | 0.032 | 0.007 | 0.009 | ○ | ○ | 687 | 809 | 14 |
| 22 | 0.014 | 0.035 | 0.005 | 0.008 | ○ | ○ | 616 | 725 | 34 |
| 23 | 0.011 | 0.034 | 0.006 | 0.010 | ○ | ○ | 481 | 565 | 103 |
| 24 | 0.012 | 0.031 | 0.009 | 0.009 | X | ○ | 732 | 861 | 52 |
| 25 | 0.015 | 0.035 | 0.006 | 0.009 | ○ | ○ | 539 | 634 | 107 |
| 26 | 0.015 | 0.033 | 0.005 | 0.011 | X | ○ | 683 | 776 | 39 |
| 27 | 0.016 | 0.032 | 0.007 | 0.010 | X | X | 665 | 782 | 23 |
| 28 | 0.014 | 0.034 | 0.009 | 0.008 | X | ○ | 596 | 702 | 105 |
| 29 | 0.015 | 0.033 | 0.005 | 0.010 | X | ○ | 593 | 698 | 105 |
| 30 | 0.015 | 0.032 | 0.006 | 0.008 | X | ○ | 567 | 652 | 102 |
| 31 | 0.014 | 0.031 | 0.006 | 0.011 | ○ | ○ | 544 | 641 | 54 |
| 32 | 0.012 | 0.032 | 0.007 | 0.009 | X | ○ | 572 | 673 | 105 |
| 33 | 0.013 | 0.033 | 0.008 | 0.008 | X | ○ | 612 | 720 | 103 |
| 34 | 0.023 | 0.012 | 0.006 | 0.008 | X | ○ | 703 | 827 | 25 |
| 35 | 0.005 | 0.042 | 0.005 | 0.010 | X | ○ | 694 | 816 | 31 |
| 36 | 0.002 | 0.008 | 0.007 | 0.010 | X | ○ | 623 | 716 | 118 |
| 37 | 0.002 | 0.007 | 0.006 | 0.009 | X | ○ | 660 | 769 | 33 |

Weld metal test specimens Nos. 1 to 18 in Table 3 are examples of the present invention which use flux-cored wires W1 to W18, respectively and have a composition satisfying the requirements of the present invention. They are excellent in SR cracking resistance and mechanical properties. It has been confirmed that these test specimens contain desired TiC-containing $M_2C$ carbides.

On the other hand, the weld metal test specimens Nos. 19 to 37 shown in Table 4 are comparative examples which use flux-cored wires W19 to W37, respectively and have a composition unsatisfactory in any of the requirements of the present invention and therefore have the following inconveniences. In Table 4, the content which is outside the range of the present invention is underlined.

The weld metal test specimen No. 19 is an example having a large C content because it uses the wire W19 having a large C content; the weld metal test specimen No. 21 is an example having a large Si Content because it uses the wire W21 having a large Si content; and the weld metal test specimen No. 22 is an example having a large Mn content because it uses the wire W22 having a large Mn content. In any one of these test specimens, reduction in toughness is observed.

The weld metal test specimen No. 20 is an example having a small Si content because it uses the wire W20 having a small Si content; the weld metal test specimen No. 23 is an example having a small Cr Content because it uses the wire W23 having a small Cr content; and the weld metal test specimen No. 25 is an example having a small Mo content because it uses the wire W25 having a small Me content. In any one of these test specimens, reduction in YS is observed.

The weld metal test specimen No. 24 is an example having a large Cr content because it uses the wire W24 having a large Cr content; and the weld metal test specimen No. 26 is an example having a large Mo content because it uses the wire W26 having a large Mo content. In each of these test specimens, deterioration of toughness and SR cracking are observed.

The weld metal test specimen No. 27 is an example having a small Ti content and small P value because it uses the wire W27 having a small Ti content and a small P value. In this test specimen, SR cracking is observed. In addition, deterioration in toughness due to the occurrence of ferrite bands is observed.

The weld metal test specimen No. 28 is an example having a large Ti content because it uses the wire W28 having a large Ti content. In this test specimen, SR cracking is observed.

The weld metal test specimen No. 29 is an example having a large B content because it uses the wire W29 having a large B content. In this test specimen, SR cracking is observed.

The weld metal test specimen No. 30 is an example having a large N content because it uses the wire W30 having a large N content. In this test specimen, SR cracking is observed.

The weld metal test specimen No. 31 is an example having a large O content because it uses the wire 31 having a small content of Mg which is a strong deoxidizing element. In this test specimen, reduction in both YS and toughness is observed.

The weld metal test specimen No. 32/No. 33 is an example having a large/small P value because it uses the wire W32/W33 having a small/large P value. In each test specimen, SR cracking is observed.

The weld metal test specimen No. 34 is an example having an Nb content exceeding the preferred range of the present invention because it uses the wire W34 having a large Nb content. In this test specimen, both occurrence of SR cracking and deterioration in toughness are observed.

The weld metal test specimen No. 35 is an example having a V content exceeding the preferred range of the present invention because it uses the wire 35 having a large V content. In this test specimen, both occurrence of SR cracking and deterioration in toughness are observed.

The weld metal test specimen No. 36 is an example having large C content, Ti content, B content and N content and a large P value because it uses the wire W36 having large C content, Ti content, B content and N content and a large P value. In this test specimen, SR cracking is observed.

The weld metal test specimen No. 37 is an example having large Mo, Ti, B and N contents and a large P value because it uses the wire W37 having large Mo, Ti, B and N contents and a large P value. In this test specimen, occurrence of SR cracking and also deterioration in toughness are observed.

It has been confirmed that any of these weld metal test specimens obtained in Comparative Examples do not contain desired TiC-containing $M_2C$ carbides.

What is claimed is:

1. A weld metal comprising:

C: 0.02 to 0.06% (mass %, which will equally apply hereinafter);

Si: 0.1 to 1.0%;

Mn: 0.3 to 1.5%;

Cr: 2.0 to 3.25%;

Mo: 0.8 to 1.2%;

Ti: 0.010 to 0.05%;

B: 0.0003% or less (inclusive of 0%);

N: 0.002 to 0.0120%;

O: 0.03 to 0.07%; and

Fe and inevitable impurities, wherein a ratio of the Ti content [Ti] to the N content [N] satisfies the following range: $2.00<[Ti]/[N]<6.25$.

2. The weld metal according to claim 1, further comprising Nb: 0.01% or less (exclusive of 0%) and/or V: 0.03% (exclusive of 0%) or less.

3. The weld metal according to claim 2, wherein the weld metal has a P content suppressed to 0.012% or less (exclusive of 0%) and has an S content suppressed to 0.012% or less (exclusive of 0%).

4. A welded construction comprising a weld metal as claimed in claims 3.

5. A welded construction comprising a weld metal as claimed in claim 2.

6. The weld metal according to claim 1, wherein the weld metal has a P content suppressed to 0.012% or less (exclusive of 0%) and has an S content suppressed to 0.012% or less (exclusive of 0%).

7. A welded construction comprising a weld metal as claimed in claim 6.

8. A welded construction comprising a weld metal as claimed in claim 1.

9. A weld metal according to claim 1, comprising:

C: 0.03 to 0.05% (mass %, which will equally apply hereinafter);

Si: 0.2 to 0.8%;

Mn: 0.5 to 1.2%;

Cr: 2.1 to 3.0%;

Mo: 0.9 to 1.1%;

Ti: 0.020 to 0.045%;

B: 0.0003% or less (inclusive of 0%);

N: 0.004 to 0.011%;

O: 0.04 to 0.06%; and

Fe and inevitable impurities, wherein a ratio of the Ti content [Ti] to the N content [N] satisfies the following range: $3.00 \leqq [Ti]/[N] \leqq 6.00$.

10. A weld metal comprising:

C: 0.02 to 0.06% (mass %, which will equally apply hereinafter);

Si: 0.1 to 1.0%;

Mn: 0.3 to 1.5%;

Cr: 2.0 to 3.25%;

Mo: 0.8 to 1.2%;

Ti: 0.020 to 0.035%;

B: 0.0005% or less (inclusive of 0%);

N: 0.002 to 0.0120%;

O: 0.03 to 0.07%; and

Fe and inevitable impurities, wherein a ratio of the Ti content [Ti] to the N content [N] satisfies the following range: $2.00<[Ti]/[N]<6.25$.

* * * * *